US010973294B2

(12) United States Patent
Grannan

(10) Patent No.: US 10,973,294 B2
(45) Date of Patent: Apr. 13, 2021

(54) MECHANICAL CARD ORGANIZING WALLET

(71) Applicant: Timothy Oliver Grannan, Gainesville, FL (US)

(72) Inventor: Timothy Oliver Grannan, Gainesville, FL (US)

( * ) Notice: Subject to any disclaimer, the term of this patent is extended or adjusted under 35 U.S.C. 154(b) by 427 days.

(21) Appl. No.: 16/015,685

(22) Filed: Jun. 22, 2018

(65) Prior Publication Data

US 2018/0368547 A1 Dec. 27, 2018

Related U.S. Application Data

(60) Provisional application No. 62/523,864, filed on Jun. 23, 2017.

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/065* (2013.01); *A45C 2001/067* (2013.01)

(58) Field of Classification Search
CPC ... A45C 11/182; A45C 1/06; A45C 2001/065; A45C 2001/067
See application file for complete search history.

(56) References Cited

U.S. PATENT DOCUMENTS 306,291 A * 10/1884 Smyth ..... B42F 17/32 40/376
1,803,023 A * 4/1931 Lessin ..... A45D 33/006 132/295
3,265,453 A * 8/1966 Seide ..... G11B 33/04 312/9.59
4,875,743 A * 10/1989 Gelardi ..... G11B 33/0444 312/9.42
5,246,020 A * 9/1993 Wu ..... A45D 33/18 132/295
5,332,086 A * 7/1994 Chuang ..... G11B 33/0438 206/308.3
7,464,819 B2 * 12/2008 Maietta ..... B65D 83/0463 206/1.5

(Continued)

FOREIGN PATENT DOCUMENTS

JP 2011115341 A * 6/2011 ..... A45C 11/182

*Primary Examiner* — Tri M Mai
(74) *Attorney, Agent, or Firm* — Matthew L. Jamison

(57) ABSTRACT

The present invention relates to a wallet that for organizing and displaying credit cards in a secure but easily accessible manner. The wallet includes a generally rectangular exterior hard case with a recess for concealing least one card holding tray therein. The card holding trays are pivotally connected to the exterior hard case, preferably by an internal pivot shaft, and a spring mechanism provides an assisting force for both opening the card holding trays from the exterior case and closing the card holding trays back into the case. Each tray may also include a slot and post arrangement that engages adjacent trays such that when a first tray rotates out of the case, the adjacent tray is also forced out of the case into a fanned-out arrangement. One or more trays may also define a finger lever whereby a user may apply an opening force to open the tray out of the case.

10 Claims, 8 Drawing Sheets

(56) References Cited

U.S. PATENT DOCUMENTS

| | | | | |
|---|---|---|---|---|
| 9,339,094 | B2 * | 5/2016 | Tucker-Skow | A45C 11/182 |
| 9,876,523 | B2 * | 1/2018 | Hodroj | A45C 11/182 |
| 2002/0027837 | A1 * | 3/2002 | Weber | G06Q 20/342<br>369/14 |
| 2018/0368547 | A1 * | 12/2018 | Grannan | A45C 11/182 |

* cited by examiner

MECHANICAL CARD ORGANIZING WALLET

CROSS REFERENCE TO RELATED APPLICATIONS

This application claims priority to U.S. Provisional Patent Application No. 62/523,864, filed Jun. 23, 2017.

BACKGROUND OF THE INVENTION

The present invention relates to a credit card and/or debit card wallet that securely holds and organizes one or more credit cards, debit cards or other varieties of similarly-sized cards, including driver's licenses or identification cards, rewards or membership cards, and business cards (hereinafter, the term "credit card" is used to encompass credit cards, as well as all other commonly known varieties of similarly shaped and sized cards).

In the modern world, the credit card has become a preferred method of payment for the purchase of goods and services. Use of credit cards and the like has become so widespread that many individuals no longer carry currency in the form of bills or coins and, instead, rely almost exclusively on credit cards to conduct their financial transactions. Additionally, many financial institutions have encouraged the widespread adoption of credit cards or debit cards as the preferred format for conducting transactions. The credit card is so universally accepted that international standards have been adopted to govern their dimensions, construction and materials, and other physical characteristics such as bending stiffness, flammability, and durability. Thus, as use of credit cards has proliferated, many individuals now carry multiple credit cards or similar-sized cards. An individual can easily carry half a dozen or more cards, which places a premium upon securing, protecting, and organizing the cards in a reliable fashion.

SUMMARY OF THE INVENTION

The present invention is for a wallet that uses a spring-actuated mechanism for organizing and displaying credit cards in a secure but easily accessible manner. The wallet includes a generally rectangular exterior hard case with a recess for concealing least one card holding tray therein. The card holding trays are pivotally connected to the exterior hard case, preferably by an internal pivot shaft and include side rails and a raised biasing member that together apply a sufficient amount of pressure to the credit card to retain it within the holding tray. Each tray may also include a slot and post arrangement that engages adjacent trays such that when a first tray rotates out of the case, the adjacent tray is also forced out of the case.

In operation, a card holding tray rotates about the pivot post such that the holding tray and the card held therein fan outward from the exterior case thereby allowing the wallet owner access to the card(s). A spring provides an assisting opening force to urge the card holding tray to rotate about the pivot shaft and out of the exterior case when opened, and an opposite closing force that retains the holding trays within the exterior case when the trays are placed in their fully closed position. Additionally, as each tray rotates out of the wallet, a post provided on the first tray engages with the end of a slot provided in an adjacent, second tray such that the continued rotation of the tray and its post urges the stationary tray to also rotate out of the wallet to an open, fanned out position. Thus, the card trays and exterior case together provide protection and security to any credit cards held within the card trays.

DETAILED DESCRIPTION

The singular terms "a," "an," and "the" include plural referents unless context clearly indicates otherwise. The term "comprises" means "includes." In case of conflict, the present specification, including explanations of any terms, will control.

The present disclosure concerns embodiments of a card-organizing wallet that is well suited for organizing, retaining, and protecting credit cards that a person may carry with their personal possessions. A card-organizing wallet of the present invention achieves this goal through several features that securely hold and protect the cards within a hard case when not in use. When the individual carrying the card-organizing wallet needs to access one or more of the credit cards, the wallet quickly rotates the cards out of the hard case into a fan-like array so that the individual may easily identify and remove the desired card from the wallet to conduct the necessary transaction. Once the selected card has been removed from the wallet, the other cards can be quickly returned to their concealed position inside the hard case.

Figure 1:
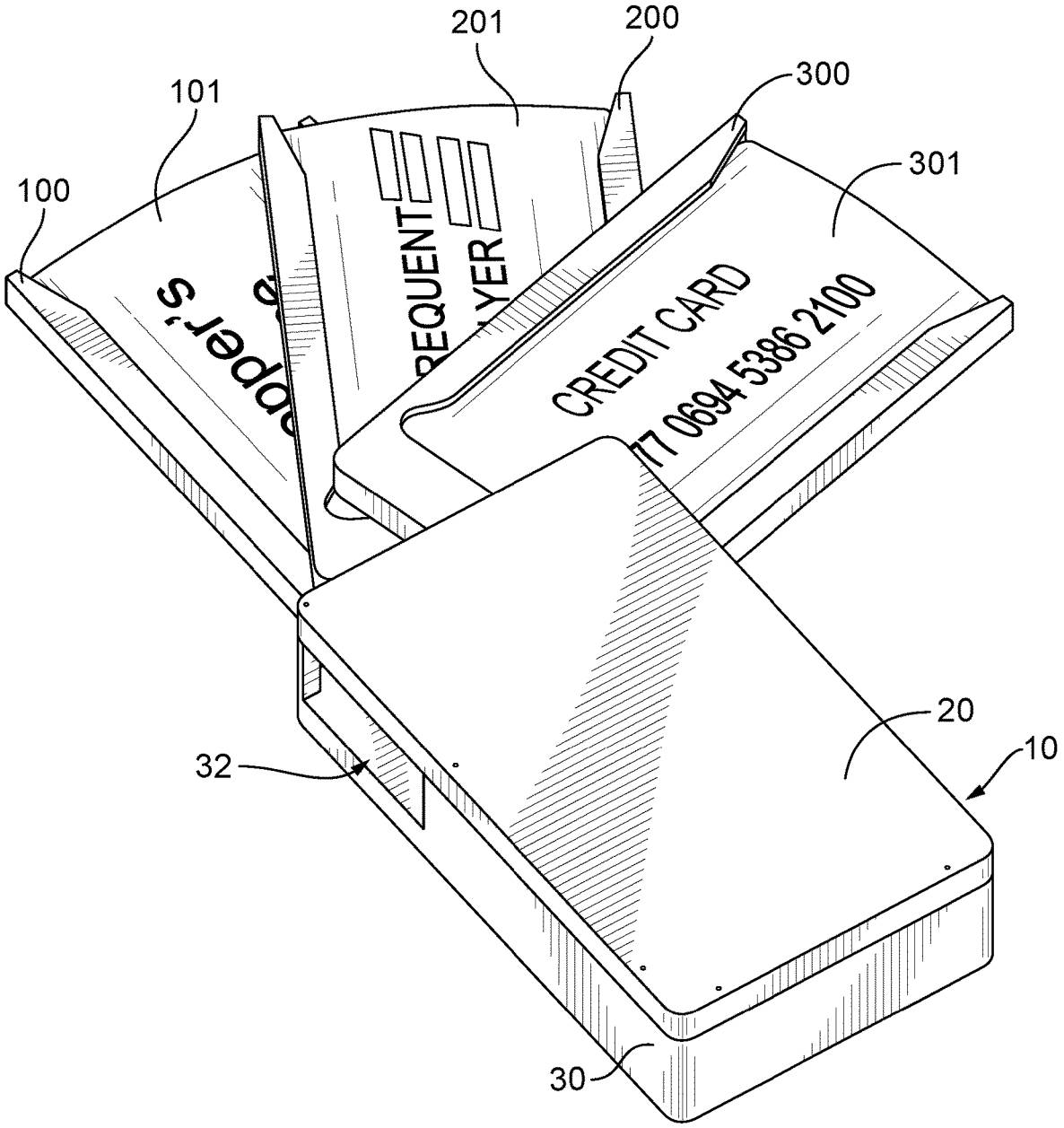
FIG. 1 is a perspective view of an exemplary embodiment of a protective card organizing wallet looking down from the top of the wallet while in a fully opened position.

FIG. 1 shows a preferred embodiment of the protective card organizing wallet 10 according to the present invention, which includes an optional front cover 20, a rear cover 30, and a plurality of card holding trays 100, 200 and 300 shown in a fully-opened position while holding cards 101, 201, and 301. As will become apparent below, wallet 10 may include any appropriate number of card holding trays, depending on the preferred dimensions of the wallet when completely assembled and the number of cards to be stored within the wallet, although common arrangements will involve one to four trays. In a preferred embodiment, rear cover 30 defines a slot 32 that accommodates finger lever 102 (shown in FIGS. 2, 4A, and 4B) provided in first card holding tray 100.

Figure 2:
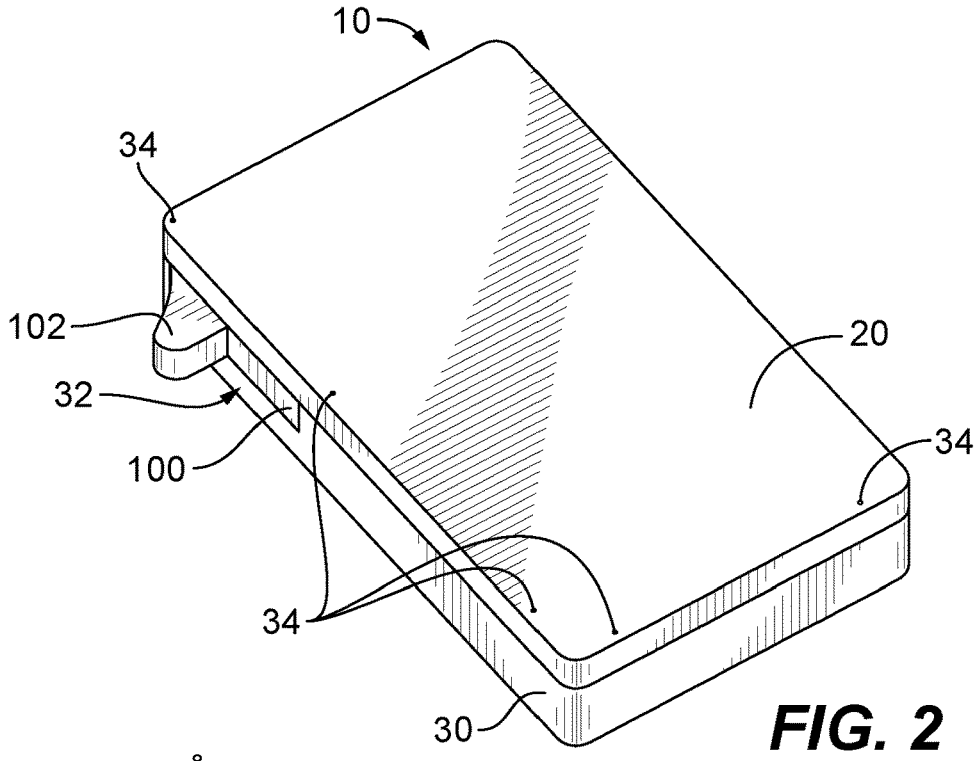
FIG. 2 is a perspective view of an exemplary embodiment of a protective card organizing wallet looking down from the top of the wallet while in a fully closed position.

FIG. 2 shows a preferred embodiment of the protective card-organizing wallet 10 with card holding trays 100 (partially visible), 200 (not visible), and 300 (also not visible) in a fully closed position. In this embodiment, when fully closed, optional top cover 20 and bottom cover 30 together conceal the card holding trays and their cards. Finger lever 102 of card holding tray 100 protrudes through slot 32 and may be pressed by a user to rotate the card holding trays into their open position (as shown in FIG. 1) when the user desires to access a card held within the tray.

In a preferred embodiment, card organizing wallet 10, along with the holding trays 100, 200, and 300 and other components are machined from aluminum; however, it should be understood that the present invention could be made from any durable material, including, for example, machined or forged metals, such as steel or titanium, wood, injection molded or printed plastics, composite materials, or a combination of these or other materials. Additionally, in the embodiment shown in FIG. 2 optional front cover 20 and rear cover 30 are assembled using threaded fasteners 34; however, any appropriate manner of assembling the covers together, including welding, press fitting, the use of rivets or other fasteners, adhesives, or other commonly known assembly methods may be employed to achieve the desired structural integrity and aesthetic appearance.

Figure 3:
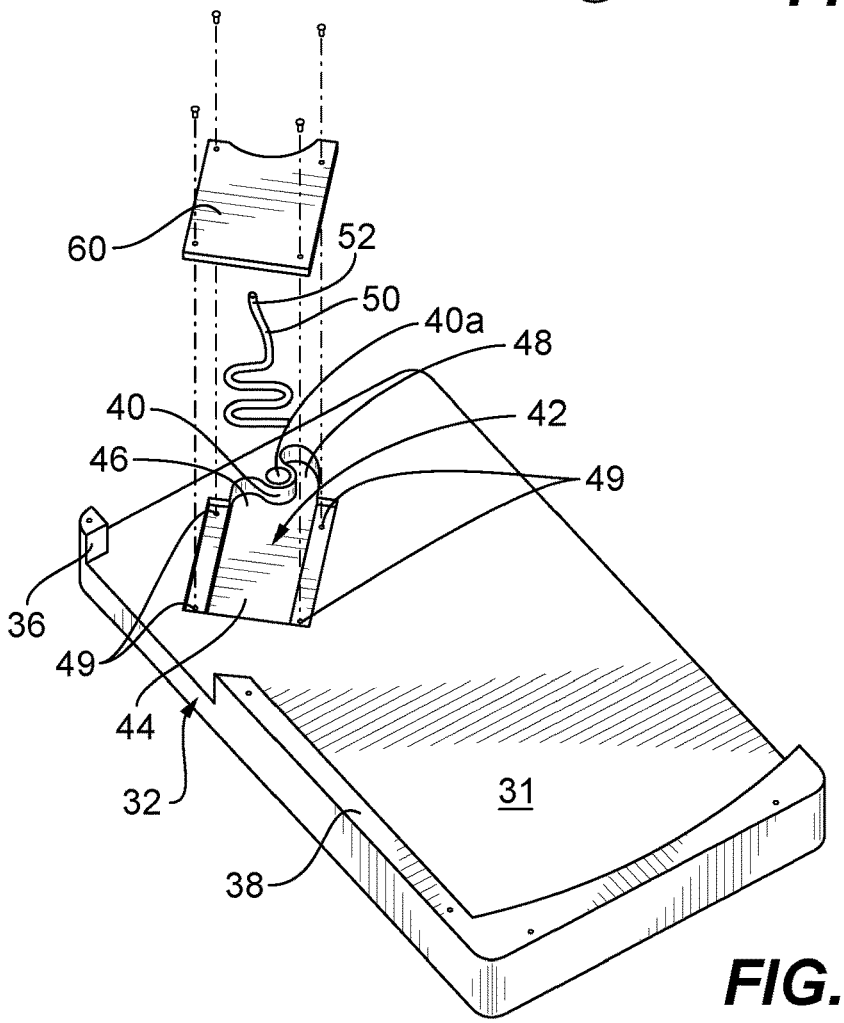
FIG. 3 is a perspective view of the rear cover and spring mechanism of an exemplary embodiment of a protective card-organizing wallet.

FIG. 3 shows a top perspective view of a preferred embodiment of the protective card organizing wallet with optional front cover 20 removed, revealing the interior of rear cover 30. Rear Cover 30 may define an internal surface 31, a corner post 36, and an enclosure wall 38 both extending upward from internal surface 31. Corner post 36 and enclosure wall 38 are sufficiently spaced apart that they together with front cover 20 (not shown) define slot 32 when the wallet is fully assembled.

The card-organizing wallet of the present invention utilizes spring-assisted action to open the card holding trays into their fully opened, fanned-out position, and also to securely hold the card holding trays in their fully closed positions. While springs are assisted openers are commonly known in the art, such as torsional springs and spring-actuated latches, the present invention relies upon a serpentine spring to apply sufficient force to hold the card trays securely in the closed position, until the user opens the trays, in which case the serpentine spring then provides spring-assisted opening action.

In the preferred embodiment, rear cover 30 defines pivot boss 40 and a spring chamber 42, which receives and locates a compression serpentine spring 50. Spring chamber has a main chamber 44, a first lobe 46, a second lobe 48, and a plurality of fastener holes 49. A cover 60 may be provided to securely locate serpentine spring 50 within main chamber 44 during operation as discussed later in connection with FIGS. 5A-5C. Cover 60 may be optionally held in place by threaded fasteners, rivets, studs that are press fit into fastener holes 49, adhesives, or any other commonly known fastening means.

Figure 4A:
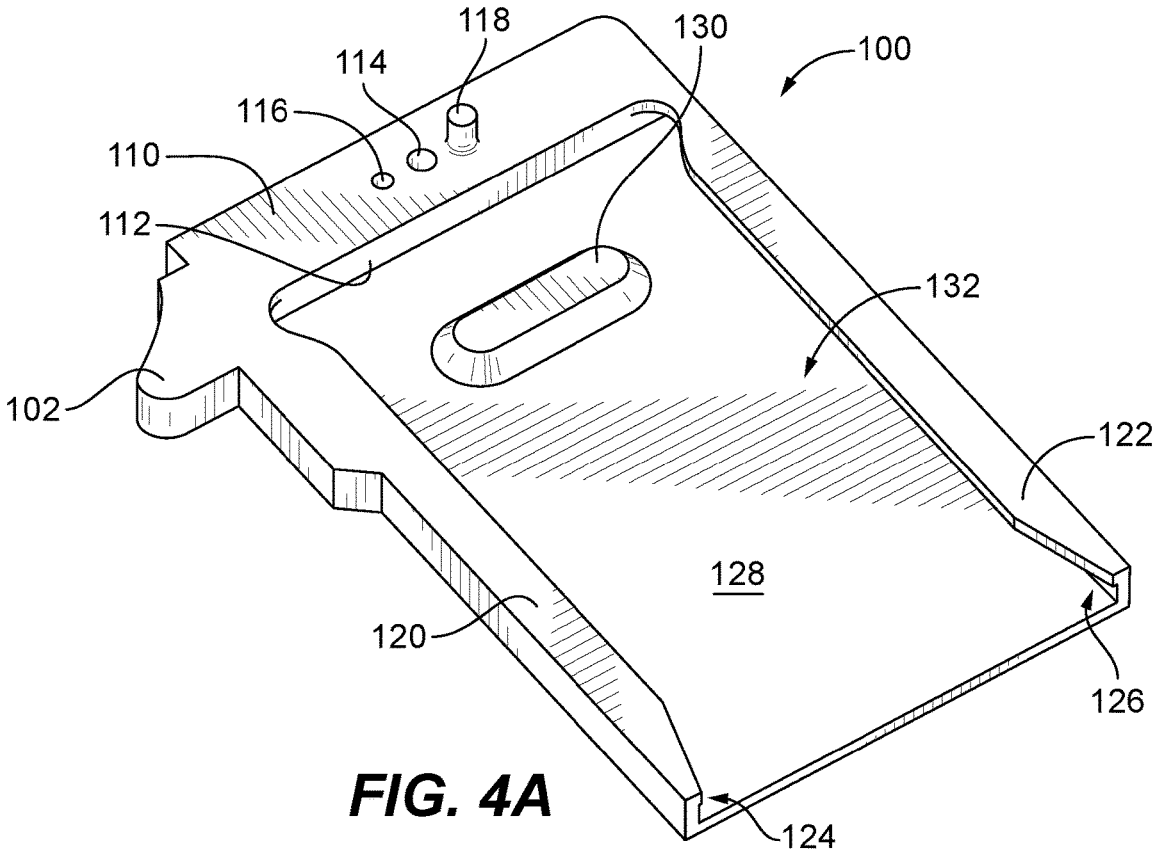
FIG. 4A is a top perspective view of an exemplary embodiment of a first card holding tray.

FIG. 4A shows a perspective view of first card holding tray 100, which defines a top region 110 that further defines a stop shoulder 112. Tray 100 preferably also has two side rails 120, 122, each defining a channel 124, 126 sized appropriately to receive the long edge of a common credit card, identification card, or the like. The tray may also have a tray back 128 that defines a card biasing ridge 130, located proximate to shoulder stop 112. Stop shoulder 112, together with channels 124, 126 and tray back 128 defines a card recess 132 into which a credit card 140 may be inserted as shown in FIG. 4C. Tray top region 110 also defines a pivot hole 114, for pivotal connection with rear cover 30 (FIG. 3) as described in greater detail below, a spring receiving hole 116, and a driver post 118.

Figure 4B:
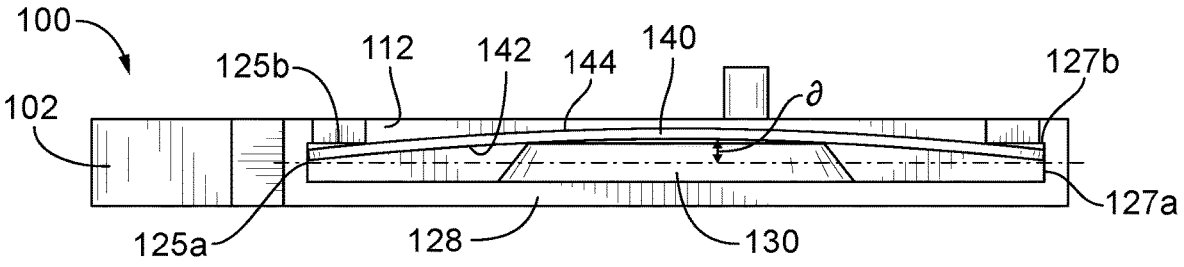
FIG. 4B is an end-on view of an exemplary embodiment of a first card holding tray.
Figure 4C:
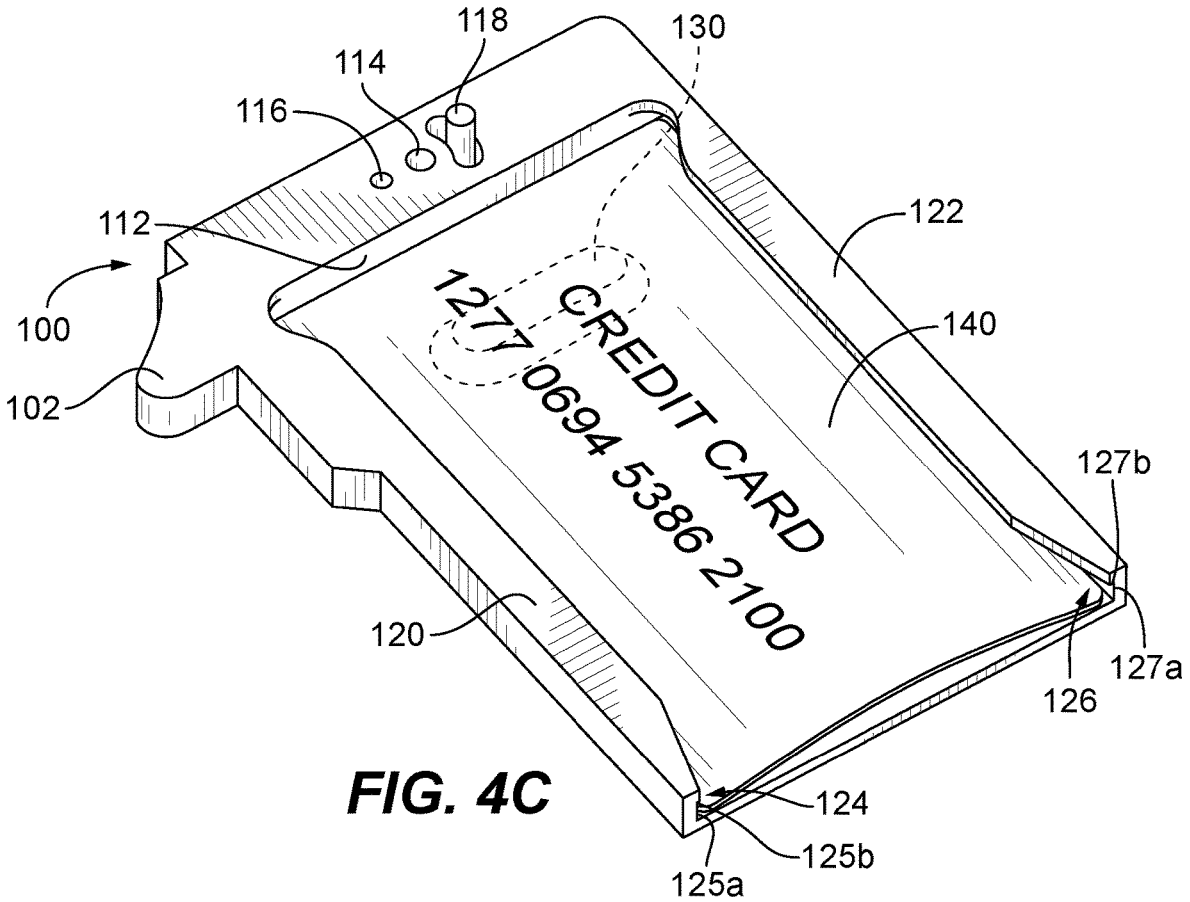
FIG. 4C is a top perspective view of an exemplary embodiment of a first card holding tray with a credit card inserted therein.

Referring to FIGS. 4B and 4C, channels 124 and 126 each define an internal vertical surface, 125*a*, 127*a* and an internal horizontal surface 125*b*, 127*b*. The wallet owner may insert a credit card lengthwise into tray 100 such that channels 124, 126 receive the elongated edges of the credit card (as shown in FIG. 4C) and sliding the card into card recess 132 (visible in FIG. 4A). As the user slides card 140 into the card recess, the card reverse surface 142 (FIG. 4B) engages and slides over card biasing ridge 130 until the card's short edge abuts shoulder stop 112. Biasing ridge 130 forces card 140 to deflect a slight amount, $\partial$ (FIG. 4*b*) and forces card obverse surface 144 to snug up against channel horizontal surfaces 125*b*, 127*b*. Cards are commonly fashioned from plastic materials that possess some inherent resiliency, and biasing ridge 130 is sized appropriately to deflect the card well within the proportional limit of the card's material, thus avoiding damaging the card. Additionally, the natural urge of the resilient card to return from it stressed, deflected position to an unstressed, non-deflected position creates a slight compressive force between the biasing ridge 130 and the card reverse surface 142, while the channel horizontal surfaces 125*b*, 127*b* apply an opposite compressive force upon card obverse surface 144. The interaction of these compressive forces is sufficient to retain the card securely within the card recess until the user slides the card out of the card recess. It should be appreciated that other means of securely retaining the card within the card recess may be employed, such as, for example, textured or rubberized surfaces that provide sufficient friction to retain the card, sleeve arrangements, and the like.

Figure 4D:
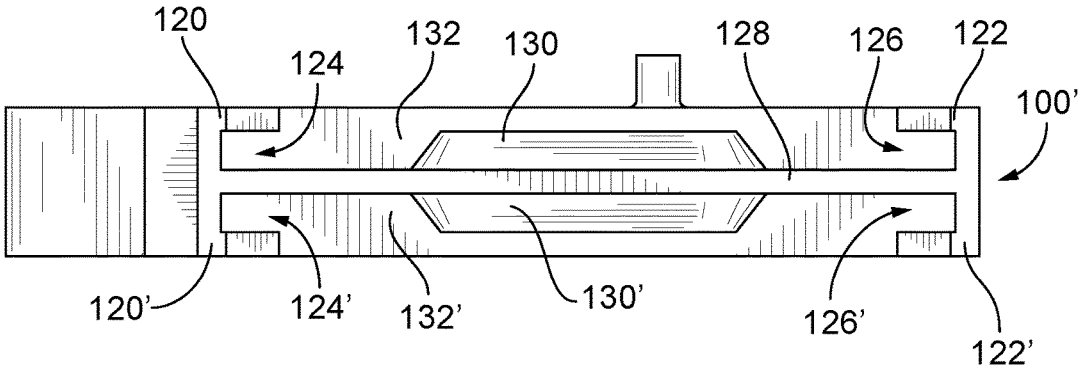
FIG. 4D is an end-on view of an alternate embodiment of a first card holding tray.

FIG. 4D shows an alternate arrangement of card tray 100' that may accommodate two credit cards, by utilizing a double-sided arrangement that provides an additional set of side rails 120', 122' on the opposite side of tray back 128 from side rails 120, 122. Side rails 120' and 122' function identically to side rails 120 and 122 as described above in connection with FIGS. 4*a*-4*c*. Channels 124', 126' and tray back 128 together define card recess 132' and an additional biasing ridge 130' is provided to retain a card within card recess 132' as describe above in connection with FIGS. 4B and 4C. When fully opened, the user has easy access to cards retained within both card recesses 132 and 132'.

Figure 5A:
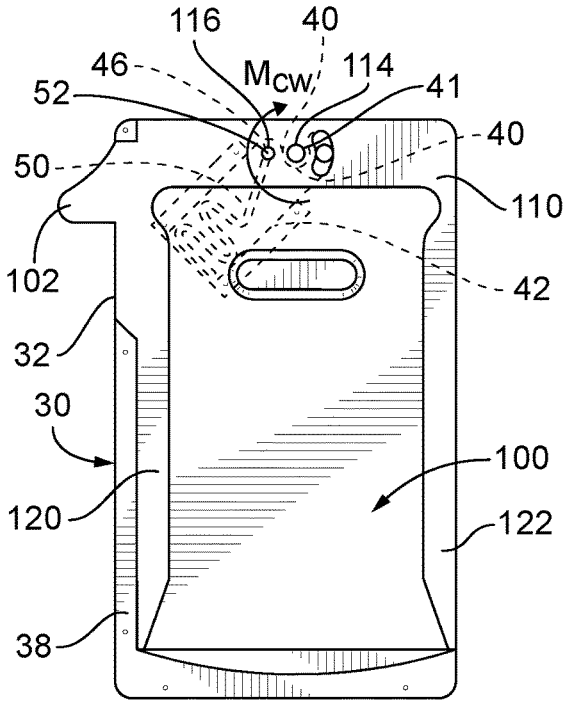
FIG. 5A is a top view of an exemplary embodiment of the protective card-organizing wallet with the front cover removed showing a first card holding tray in a fully closed position.

As mentioned previously, the spring-assisted action of the present card organizing wallet is described with reference to FIGS. 5A, 5B, and 5C, each showing a preferred embodiment of the wallet of the present invention with the front cover 20 and second and third card trays 200, 300 removed. With particular reference to FIG. 5*a*, card tray 100 is shown in its fully closed position, with finger lever 102 extending through slot 32 and accessible by the user, while side rail 120 abuts enclosure wall 38. A pivot shaft 41, which may be any kind of commonly known structure, such as a sleeve, lubricated pin, or bearing, is inserted through pivot hole 114 and is received into a corresponding hole 40*a* (FIG. 3) provided in pivot boss 40 and provides the rotational axis about which tray 100 may rotate when opened.

Serpentine spring 50 is located within spring chamber 42 with spring end 52 positioned in first lobe 46 and received within spring hole 114 defined in top region 110 of tray 100. In a preferred embodiment, serpentine spring 50 is a compression spring sized appropriately such that it is slightly compressed when tray 100 is in its fully closed position. Thus spring 50 applies a clockwise rotational moment $M_{CW}$ about pivot shaft 41 upon tray 100 and retaining tray 100 in its closed position. The abutting engagement between side rail 120 and enclosure wall 38 prevents tray 100 from over-rotating beyond its fully closed position, while the clockwise moment $M_{CW}$ prevents tray 100 from inadvertently opening.

Figure 5C:
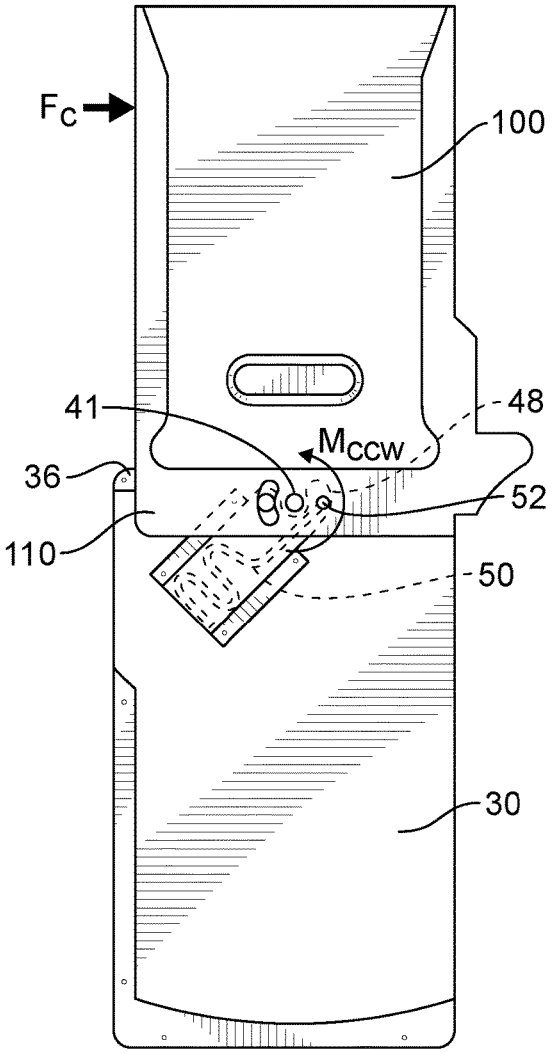
FIG. 5C is a top view of an exemplary embodiment of the protective card-organizing wallet with the front cover removed showing the first card holding tray in a fully open position.
Figure 5B:
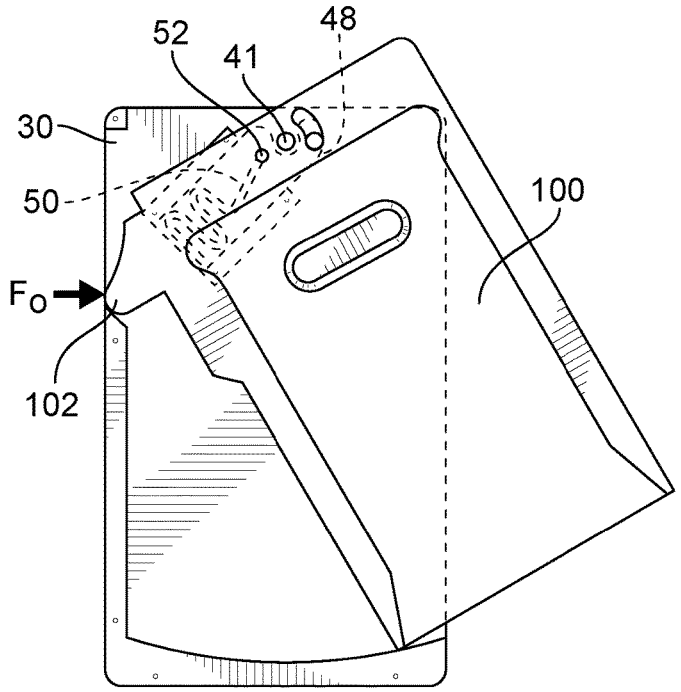
FIG. 5B is a top view of an exemplary embodiment of the protective card-organizing wallet with the front cover removed showing a first card holding tray in a partially open position.

FIG. 5B shows card tray 100 in a partially opened position that is the result of a user applying a force $F_O$ to finger lever 102 sufficient to rotate tray in a counter-clockwise manner about pivot pin 41 against the counterclockwise moment $M_{CW}$ (FIG. 5A). As tray 100 rotates, serpentine spring 50 is further compressed, thus increasing the spring force such that if the user stops pressing finger lever 102, the spring force will create sufficient moment $M_{CW}$ to rotate tray 100 clockwise about pivot shaft 41, thus returning tray 100 to its closed position. However, if the user applies additional force $F_O$ to finger lever 102, tray 100 will rotate counterclockwise about pivot pin 41 until the spring force urges serpentine spring 50 to unload and expand spring end 52 into second lobe 48, thereby further rotating tray 100 counterclockwise into an open position shown in FIG. 5C. It should be understood that in alternate embodiments the position of finger lever 102 and the arrangement of serpentine spring 50 could easily be mirrored such that tray 100 rotates in a clockwise manner towards the open position and a counterclockwise manner toward the closed position without changing the nature of the invention disclosed herein. It should be also be understood that finger lever 102 may be located anywhere on tray 100 that allows a user to access the finger lever and apply sufficient force $F_O$ to overcome the closing force of moment $M_{CW}$ (FIG. 5A), thereby forcing serpentine spring to unload and provide an assisting opening moment $M_{CCW}$ (FIG. 5C) as discussed below.

FIG. 5C shows tray 100 in the fully open position with top portion 110 abutting corner post 36, thus preventing the tray from further rotating about pivot shaft 41. Spring end 52 is now positioned in second lobe 48. As discussed before, Serpentine spring 50 is preferably sized appropriately such that it is still slightly compressed when tray 100 is in the fully open position. Accordingly, spring 50 continues to apply a counterclockwise moment $M_{CCW}$ on tray 100 about pin 41, with moment $M_{CCW}$ preferably being sufficient to hold tray 100 in its fully opened position until a user applies a sufficient force $F_C$ upon tray 100 to rotate it clockwise back through the partially opened position (as shown in FIG. 5*b*) until spring end 52 passes the point of maximum compression and unloads urging spring end 52 towards first lobe 46 (as shown in FIG. 5A), thus rotating tray 100 to its fully closed position. Thus, spring member 50 provides a two-way biasing force that assists in both opening and closing tray 100 from the cover.

It should be appreciated that any appropriate spring could be substituted for the serpentine spring described herein, such as any alternative form of compression spring, including, for instance, a coil spring or elastomeric materials that resilient to compressive forces, placed in a similar arrangement to provide force for assisting the opening and closing of the card tray.

Other envisioned embodiments may include a tension spring attached at one end to the pivot boss and at the opposite end to the underside of the card tray, such that as the card tray rotates from its closed position towards the open position, or vice versa, the tension spring loads until it reaches maximum deflection, at which point it unloads and applies an opening or closing force upon the card tray. Any suitable tension springs, such as coil springs, elastomeric bands, or the like may be utilized to provide the spring force necessary to assist the opening and closing of the card tray.

Alternatively, an alternative embodiment may employ a wire spring that flexes in response to the movement of a cam surface formed integral with or as an assembly onto the underside of tray 100, such that as the tray rotates from the closed position toward the open position, the cam surface engages and deflects the wire spring. Once the cam surface passes the point of maximum spring deflection, the wire spring unloads and returns to its normal position and in so doing applies a force upon the cam surface that continues to propel the tray into its fully opened position. Conversely, as the user returns the tray to its closed position, the cam surface once again engages and deflects the wire spring until the rotation of the tray forces the cam surface passes the point of maximum spring deflection, and the wire spring returns to its normal position and applies a force upon the cam surface that continues to propel the tray towards its fully closed position.

Still other embodiments may utilize a torsion spring that applies a torque that urges tray 100 toward the open position. In such embodiments, a retaining clasp may be utilized that, when engaged with the tray, holds the tray in the closed position against the spring's torque until the user disengages the clasp from the tray, thus allowing the spring to urge the tray into its open position.

As can be seen from the preceding paragraphs, many alternative springs, materials with resilient properties, and alternative mechanisms may be substituted in the present disclosure to achieve the assisted opening and closing. The present invention is not limited to the preferred embodiment descried in detail herein, and, instead, contemplates the substitution of alternative materials and arrangements for those specifically disclosed herein.

Figure 6:
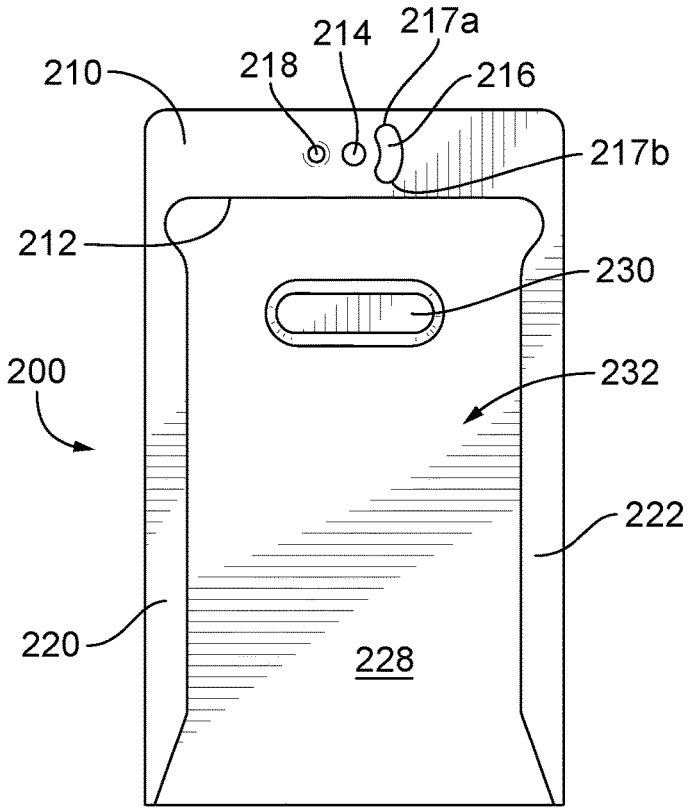
FIG. 6 is a top view of an exemplary embodiment of a second card holding tray.
Figure 7:
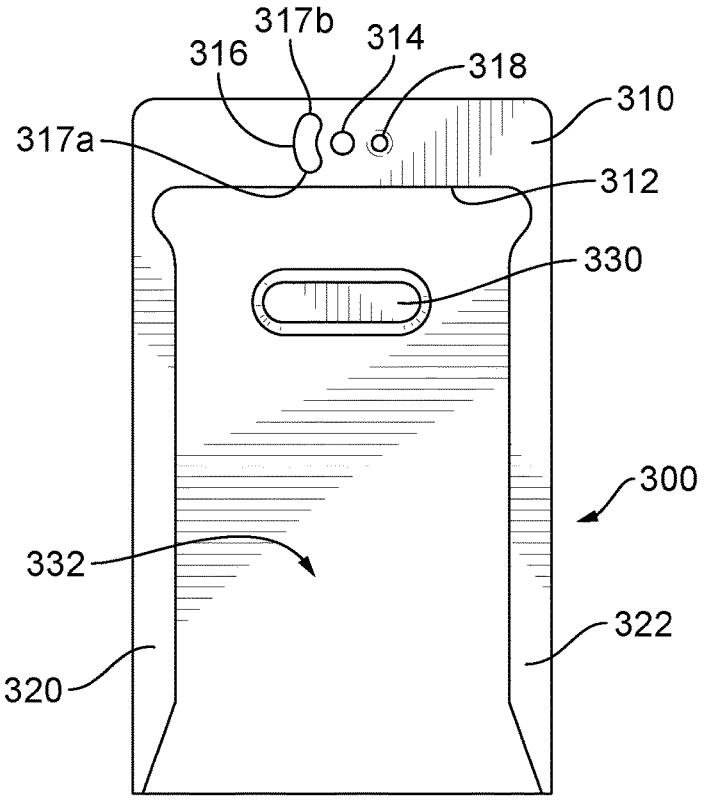
FIG. 7 is a top view of an exemplary embodiment of a third card holding tray.

FIGS. 6 and 7 show top views of a second tray 200 and a third tray 300, respectively. Both second and third trays are largely identical to first tray 100 (FIG. 4A), each having a top portion 210, 310 that defines a shoulder stop 212, 312, pivot holes 214, 314, arced slots 216, 316, and optional driver posts 218, 318. Second and third trays 200, 300 also have side rails 220, 222, 320, 322 that each define channels (not shown) for receiving the long edge of a card, a card biasing ridge 230, 330, and a card recess 232, 332. The second and third trays 200, 300 utilize the same design features as the first tray for securely retaining the card within the card recess by deflecting the card slightly and relying on compressive forces to hold the card firmly in place until removed by a user. Additionally, the second and third trays may also incorporate a double-sided design similar to that described in connection with the alternate embodiment of the first tray shown in FIG. 4D.

Figure 8:
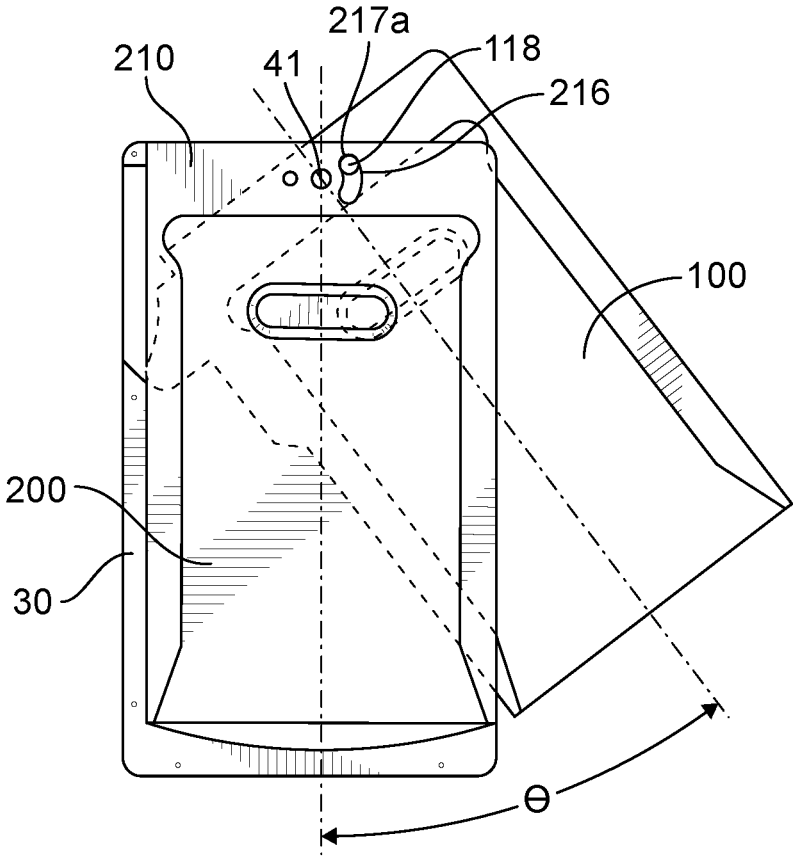
FIG. 8 is a top view of an exemplary embodiment of the protective card-organizing wallet with the cover removed showing the interaction of a first card holding tray and a second card holding tray as the first card holding tray rotates into an open position.

As shown in FIG. 8, when tray 100 rotates counterclockwise about pivot shaft 41 into an open position under the urge of the serpentine spring as described in connection with FIGS. 5*a*-5*b* above, driver post 118 freely slides within slot 216 provided within top region 210 of tray 200. When tray 100 has rotated sufficiently that post 118 abuts first end 217*a* of arced slot 216. At this point, the continued rotation of first tray 100 into an open position forces second tray 200 to also rotate into an open position; however, when tray 100 achieves its fully opened position, the engagement between post 118 and arced slot first end 217*a* prevents second tray 200 from opening further, thus allowing a user to see and access the cards held in both the first and second trays (as shown in FIG. 1). In a preferred embodiment, slot 216 allows tray 100 to rotate through an angle θ of approximately 41.5° before second tray 200 begins to rotate along with tray 100 due to the interaction of driving post 118 and slot first end 217*a;* however, it should be appreciated that angle θ may be changed to any desired angle by simply adjusting the length of arced slot 216 to allow access to any cards held within the first and second trays when the trays are fully opened.

Figure 9:
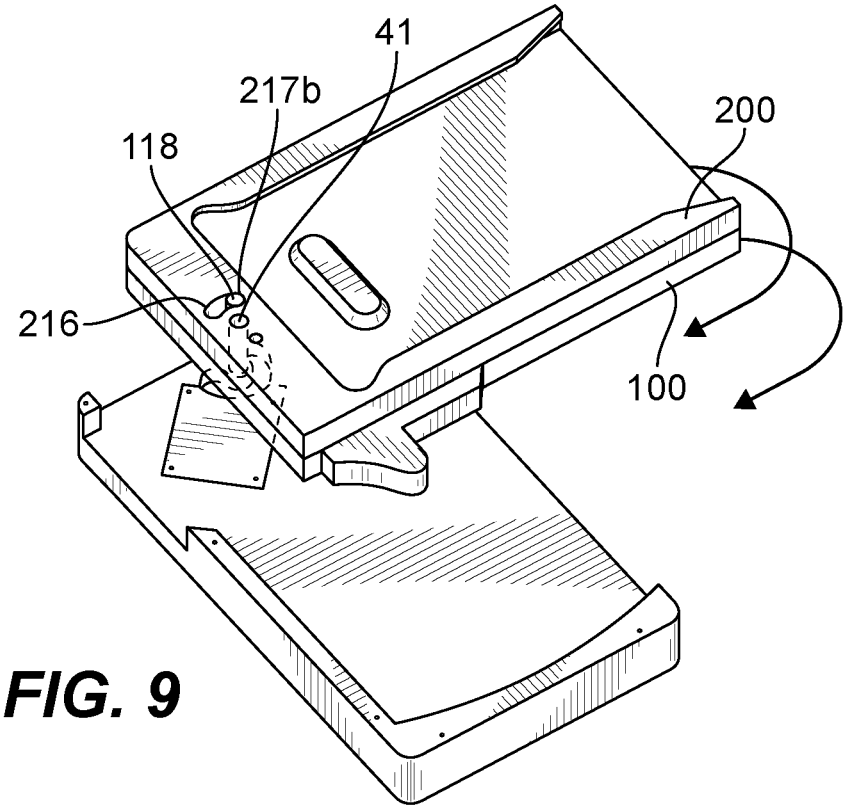
FIG. 9 is a top perspective view of an exemplary embodiment of the protective card-organizing wallet with the cover removed showing the interaction of a first card holding tray and a second card holding tray as the wallet is closing.

As shown in FIG. 9, when the user decides to rotate the trays back into their closed position, tray 100 rotates counterclockwise about pivot shaft 41 towards a closed position and driver post 118 freely slides within slot 216 until it abuts second end 217*b,* at which point the continued rotation of first tray 100 into the closed position forces second tray 200 to also rotate into its closed position. While post 118 is shown as integrally formed with tray top portion 110, any number of alternative and more economical arrangements may be employed, including press fitting a pin into a receiving hole or by inserting a threaded fastener with a sufficiently sturdy head, such as a socket cap screw, into a threaded receiving hole.

Figure 10:
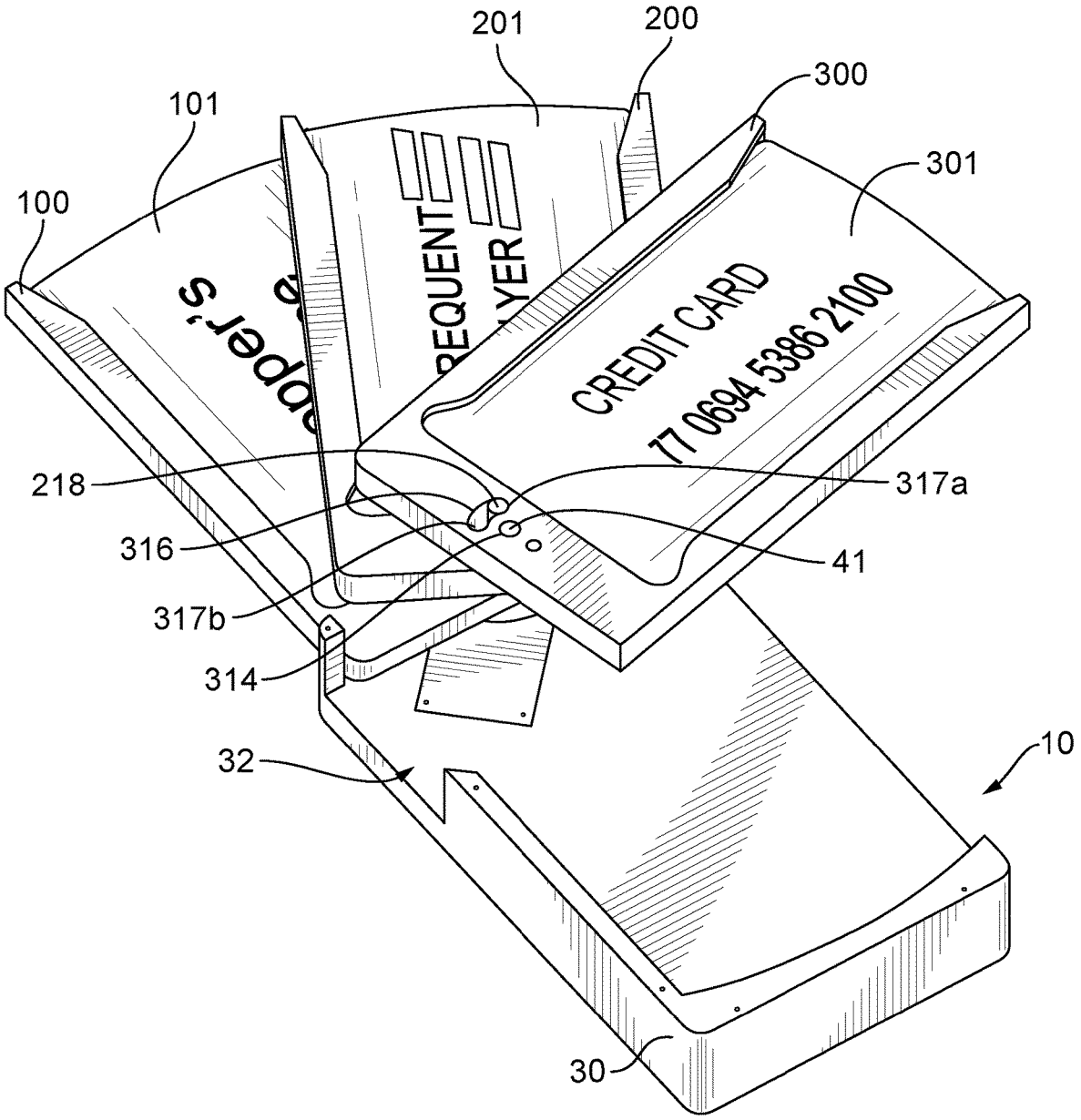
FIG. 10 is a top perspective view of an exemplary embodiment of the mechanical card-organizing wallet with the cover removed showing the interaction and arrangement of the card holding trays in a fully opened position.

Referring to FIG. 10, the engagement between optional tray 300 and tray 200 is shown. As also shown in FIG. 7, tray 300 defines a curved slot 316 is positioned on the opposite side of pivot hole 314 when compared with the placement of curved slot 216 relative to pivot hole 214 (FIG. 6). Curved slot 316 slidably receives driving post 218 when the wallet is fully assembled, similar to the interaction between driving post 118 of tray 100 and curved slot 216 of tray 200 described above in connection with FIGS. 8 and 9. Accordingly, as the first tray rotates counterclockwise about the pivot pin and begins to force the second tray into an open position, the driving post 218 of second tray 200 freely slides within slot 316 until it abuts first end 317*a,* at which point the continued rotation of first tray 100 and second tray 200 into an open position forces third tray 300 to rotate into an open position. When the user choses to rotate the trays back into their closed position, tray 100 rotates counterclockwise about pivot shaft 41 towards a closed position, and as it forces second tray 200 towards the close position, the second tray's driver post 218 freely slides within slot 316 until it abuts slot second end 317*b,* at which point the continued rotation of the first and second trays into the closed position forces third tray 300 to also rotate into the closed position. As discussed above in connection with tray 100, driver post 218 may be a pin press fit into a receiving hole, threaded fastener with a raised head, or other similar structure that would suitably replace the integrally formed driver post 218 of the present embodiment.

It should be appreciated that any number of trays may be employed using a similar arrangement of driving posts and arced slots to ensure that the rotation of each tray into an open or closed position also forces an adjacent tray into an open or closed. Such arrangements can be achieved by increasing the length of the pivot shaft, corner post, and enclosure wall accommodate the inclusion of additional trays and by reducing the angular arc of each arced slot to ensure that the trays allow a user adequate access to each tray to insert or remove a card carried therein. It should also be appreciated, as discussed above, that by simply mirroring the arrangement of the trays, one can easily create an alternate embodiment wherein the trays rotate open in a clockwise direction and rotate closed in a counterclockwise direction.

In view of the many possible embodiments to which the principles of my invention may be applied, it should be recognized that illustrated embodiments are only examples of the invention and should not be considered a limitation on the scope of the invention. Rather, the scope of the invention is defined by the claims. I therefore claim as my invention all that comes within the scope and spirit of these claims.

I claim:

1. A mechanical credit card wallet comprising:

a wallet exterior cover;

a first card holding tray pivotally mounted to said wallet exterior cover by a pivot post, said first card holding tray further defining a driving post located proximate to said pivot post, a second card holding tray pivotally mounted to said wallet exterior cover by said pivot post, said second card holding tray further defining a slot located proximate to said pivot post, said slot being sized appropriately to slidably receive said driving post of said first card holding tray, and said slot further defining a first end and a second end;

a two-way biasing mechanism, wherein said two-way biasing mechanism provides a first opening force that urges said at least first card holding tray to pivot relative to said wallet exterior cover towards an open position wherein said first card holding tray is accessible by a user, and wherein said two-way biasing mechanism provides a second closing force that urges said first card holding tray to pivot relative to said wallet exterior cover towards said closed position;

wherein said driving post engages said first end of said slot and forces said second card holding tray to rotate about said pivot post toward an open position as said first card holding tray also rotates toward said open position, and wherein said driving post engages said second end of said slot as said first card holding tray rotates toward said closed position and forces said second card holding tray to rotate about said pivot post towards a closed position.

2. The mechanical credit card wallet of claim 1 wherein rotation of said first card holding tray and said second card holding tray into said open position results in said first card holding tray and said second card holding tray being positioned in a fanned-out arrangement relative to said wallet exterior cover.

3. The mechanical credit card wallet of claim 1 wherein said two-way biasing mechanism further comprises a spring having a first end that engages said wallet exterior cover and a second end that engages said first card holding tray, wherein said spring provides both said opening force that urges said first card holding tray to pivot toward said open position relative to said wallet exterior cover and said closing force that urges said first card holding tray to pivot toward said closed position.

4. The mechanical credit card wallet of claim 3 wherein said spring is a serpentine spring.

5. The mechanical credit card wallet of claim 3 further comprising:

a spring chamber defined within said wallet exterior cover for receiving said spring, wherein said spring chamber further defines a first lobe positioned proximate to said pivot post and a second lobe positioned proximate to said pivot post and opposite said first lobe, wherein said second spring end is received within said first lobe when said first card holding tray is in said closed position and wherein said second spring end is received within said second lobe when said first card holding tray is in said open position, wherein said spring provides said opening force that forcibly urges said first card holding tray to pivot toward said open position as said second spring end moves from said first lobe toward said second lobe, and wherein said spring provides said closing force that forcibly urges said first card holding tray to pivot toward said closed position as said second spring end moves from said second lobe toward said first lobe.

6. A mechanical credit card wallet comprising:

a wallet exterior cover;

at least one card holding tray pivotally mounted to said wallet exterior cover by a pivot post; and a spring having a first end that engages said wallet exterior cover and a second end that engages said card holding tray, wherein said spring provides an opening force that urges said card holding tray to pivot toward an open position relative to said wallet exterior cover and a closing force that urges said card holding tray to pivot toward a closed position wherein said at least one tray is concealed within said wallet exterior cover;

a spring chamber defined within said wallet exterior cover for receiving said spring, wherein said spring chamber further defines a first lobe positioned proximate to said pivot post and a second lobe positioned proximate to said pivot post and opposite said first lobe, wherein said second spring end is received within said first lobe when said at least one card holding tray is in said closed position and wherein said second spring end is received within said second lobe when said at least one card holding tray is in said open position, wherein said opening force urges said at least one card holding tray to pivot toward said open position as said second spring end moves from said first lobe toward said second lobe, and wherein said closing force urges said card holding tray to pivot toward said closed position as said second spring end moves from said second lobe toward said first lobe.

7. The mechanical wallet of claim 6, wherein said spring is a serpentine spring.

8. A finger-operated mechanical credit card wallet comprising:

a wallet exterior cover;

a first card holding tray pivotally mounted to said wallet exterior cover by a pivot post such that said first card holding tray may rotate relative to said wallet exterior cover between an open position and a closed position, said first card holding tray further defining a driving post located proximate to said pivot post and a finger lever positioned appropriately for a user to apply a finger force to said at least one card holding tray, wherein said finger force urges said at least one card holding tray to pivot toward said open position, a second card holding tray pivotally mounted to said wallet exterior cover by said pivot post, said second card holding tray further defining a slot located proximate to said pivot post, said slot being sized appropriately to slidably receive said driving post of said first card holding tray and said slot further defining a first end and a second end;

wherein said driving post engages said first end of said slot as said first card holding tray rotates toward said open position and urges said second card holding tray to also rotate about said pivot post toward said open position, and wherein said driving post engages said second end of said slot as said first card holding tray rotates toward a closed position and urges said second card holding tray to also rotate about said pivot post toward said closed position.

9. The mechanical credit card wallet of claim 8 further comprising a serpentine spring having a first end that engages said wallet exterior cover and a second end that engages said first card holding tray, wherein said serpentine spring provides an opening force that supplements said finger force in urging said first card holding tray to pivot toward said open position and a closing force that urges said first card holding tray to pivot toward said closed position.

10. The mechanical credit card wallet of claim 9 further comprising:

a spring chamber defined within said wallet exterior cover for receiving said spring, wherein said spring chamber further defines a first lobe positioned proximate to said pivot post and a second lobe positioned proximate to said pivot post and opposite said first lobe, wherein said second spring end is received within said first lobe when said card holding tray is in said closed position and wherein said second spring end is received within said second lobe when said card holding tray is in said open position, wherein said spring provides said opening force as said second spring end moves from said first lobe toward said second lobe, and wherein said spring provides said closing force as said second spring end moves from said second lobe toward said first lobe.

* * * * *